US009875724B2

(12) United States Patent
Gao

(10) Patent No.: US 9,875,724 B2
(45) Date of Patent: Jan. 23, 2018

(54) METHOD AND ELECTRONIC DEVICE FOR ADJUSTING DISPLAY

(71) Applicants: Beijing Lenovo Software Ltd., Beijing (CN); Lenovo (Beijing) Co., Ltd., Beijing (CN)

(72) Inventor: Chengguo Gao, Beijing (CN)

(73) Assignees: Beijing Lenovo Software Ltd., Beijing (CN); Lenovo (Beijing) Co., Ltd., Beijing (CN)

( * ) Notice: Subject to any disclaimer, the term of this patent is extended or adjusted under 35 U.S.C. 154(b) by 100 days.

(21) Appl. No.: 13/971,120

(22) Filed: Aug. 20, 2013

(65) Prior Publication Data

US 2014/0055481 A1 Feb. 27, 2014

(30) Foreign Application Priority Data

Aug. 21, 2012 (CN) ..... 2012 1 0300023
Jun. 14, 2013 (CN) ..... 2013 1 0236594
Jun. 19, 2013 (CN) ..... 2013 1 0244013

(51) Int. Cl.
*G09G 5/02* (2006.01)

(52) U.S. Cl.
CPC ..... *G09G 5/02* (2013.01); *G09G 2320/0666* (2013.01); *G09G 2320/0693* (2013.01); *G09G 2360/144* (2013.01)

(58) Field of Classification Search
None
See application file for complete search history.

(56) References Cited

U.S. PATENT DOCUMENTS 5,726,672 A * 3/1998 Hernandez ..... G06F 3/04897 345/22
5,793,884 A * 8/1998 Farrell ..... H04N 1/6086 348/222.1
6,628,822 B1 * 9/2003 Nakabayashi ..... H04N 1/603 358/1.15
7,733,383 B2 6/2010 Kato
(Continued)

FOREIGN PATENT DOCUMENTS

CN 1940695 A 4/2007
CN 101068311 A 11/2007
(Continued)

OTHER PUBLICATIONS

First Chinese Office Action regarding Application No. 201210300023.5, dated Jan. 12, 2015.
(Continued)

*Primary Examiner* — Anh-Tuan V Nguyen
(74) *Attorney, Agent, or Firm* — Harness, Dickey & Pierce, P.L.C.

(57) ABSTRACT

The present invention discloses a method of displaying on an electronic device and an electronic device. The method is applied in an electronic device with a display unit, which includes: acquiring a first environment light parameter of an environment around the electronic device, wherein, the first environment light parameter comprises at least a second color temperature value of the environment; determining a first display parameter of the display unit according to the first environment light parameter; and displaying on the display unit with the first display parameter.

18 Claims, 6 Drawing Sheets

(56) References Cited

U.S. PATENT DOCUMENTS 7,932,915 B2 * 4/2011 Miyata ..... G09G 3/3611 345/690
7,969,478 B1 * 6/2011 Chen ..... H04N 5/58 348/223.1
7,978,021 B2 7/2011 Tamaru
8,405,674 B2 3/2013 Sakai et al.
8,463,119 B2 6/2013 Kubota
8,929,727 B2 1/2015 Kubota
2002/0089611 A1 * 7/2002 Kim ..... H04N 5/74 348/745
2004/0196250 A1 * 10/2004 Mehrotra et al. ..... 345/102
2005/0094171 A1 * 5/2005 Ogasahara ..... H04N 1/6097 358/1.9
2005/0149864 A1 * 7/2005 Matsuzaki ..... G09G 5/02 715/202
2005/0169518 A1 * 8/2005 Boston ..... G01J 3/46 382/162
2006/0097978 A1 * 5/2006 Ng ..... G02F 1/133603 345/102
2006/0164513 A1 * 7/2006 Sugiyama ..... H04N 9/73 348/180
2006/0250503 A1 * 11/2006 Crutchfield, Jr. .. G06Q 30/0601 348/207.99
2007/0035633 A1 * 2/2007 Tzou ..... H04N 5/44 348/220.1
2007/0052735 A1 * 3/2007 Chou ..... 345/690
2007/0070091 A1 * 3/2007 Cho ..... G09G 3/2003 345/690
2007/0081101 A1 * 4/2007 Diederiks et al. ..... 348/602
2007/0081102 A1 * 4/2007 Ramanath et al. ..... 348/602
2007/0182754 A1 * 8/2007 Park ..... G09G 5/02 345/589
2007/0257992 A1 11/2007 Kato
2008/0284716 A1 * 11/2008 Edwards ..... G09G 3/3406 345/102
2008/0303918 A1 * 12/2008 Keithley ..... 348/223.1
2009/0027514 A1 * 1/2009 Katano ..... 348/223.1
2009/0116082 A1 * 5/2009 Osa et al. ..... 358/501
2009/0128649 A1 * 5/2009 Osorio ..... H04N 1/6033 348/222.1
2009/0167950 A1 * 7/2009 Chen et al. ..... 348/602
2009/0207274 A1 8/2009 Park et al.
2009/0251561 A1 10/2009 Kuang et al.
2009/0322909 A1 * 12/2009 Garcia ..... G06T 15/04 348/239
2010/0026837 A1 * 2/2010 Koishi ..... H04N 1/6086 348/225.1
2010/0054582 A1 * 3/2010 Koishi ..... 382/162
2010/0103172 A1 * 4/2010 Purdy, Sr. ..... G06T 15/50 345/426
2010/0165142 A1 7/2010 Wu
2010/0188418 A1 7/2010 Sakai et al.
2010/0271390 A1 * 10/2010 Tran et al. ..... 345/619
2011/0043522 A1 * 2/2011 Zhou et al. ..... 345/426
2011/0096103 A1 * 4/2011 Kato ..... H04N 9/73 345/690
2011/0103643 A1 * 5/2011 Salsman ..... G06K 9/00261 382/103
2011/0150451 A1 6/2011 Kubota
2011/0292070 A1 * 12/2011 Hasegawa ..... H04N 1/6058 345/590
2012/0019447 A1 * 1/2012 Hanes ..... 345/168
2012/0038688 A1 * 2/2012 Deyama ..... G09G 5/02 345/690
2012/0268437 A1 * 10/2012 Lee ..... G09G 3/20 345/207
2013/0002698 A1 * 1/2013 Geiger ..... G06T 15/00 345/589
2013/0207949 A1 * 8/2013 Jiang ..... G09G 3/36 345/207
2013/0251357 A1 9/2013 Kubota
2014/0078165 A1 * 3/2014 Messmer ..... H04N 1/603 345/589
2014/0285477 A1 * 9/2014 Cho ..... G09G 3/2003 345/207
2015/0170604 A1 * 6/2015 Iwagaki ..... B64D 11/00 345/589

FOREIGN PATENT DOCUMENTS

CN 101587703 A 11/2009
CN 101604516 A 12/2009
CN 101621699 A 1/2010
CN 101771889 A 7/2010
CN 101788342 A 7/2010
CN 102104785 A 6/2011
CN 102271218 A 12/2011
CN 102479499 A 5/2012
CN 102682738 A 9/2012
EP 1770999 A2 4/2007

OTHER PUBLICATIONS

First Chinese Office Action regarding Application No. 201310236594.1 dated Feb. 6, 2016. English translation provided by Unitalen Attorneys at Law.
Third Chinese Office Action regarding Application No. 201210300023.5 dated Apr. 11, 2016. English translation provided by Unitalen Attorneys at Law.
First Chinese Office Action regarding Application No. 201310244013.9 dated Mar. 18, 2016. English translation provided by Unitalen Attorneys at Law.
Second Chinese Office Action regarding Application No. 201310244013.9 dated Nov. 22, 2016. English translation provided by Unitalen Attorneys at Law.

* cited by examiner

METHOD AND ELECTRONIC DEVICE FOR ADJUSTING DISPLAY

The present invention claims the priority of the Chinese Patent Application No. 201210300023.5, entitled "METHOD, DEVICE AND ELECTRONIC DEVICE FOR WHITE BALANCE CONTROL", filed with the Chinese Patent Office on Aug. 21, 2012 which is herein incorporated by reference in its entirety.

The present invention claims the priority of the Chinese Patent Application No. 201310236594.1, entitled "METHOD and ELECTRONIC DEVICE FOR ADJUSTING DISPLAY UNIT", filed with the Chinese Patent Office on Jun. 14, 2013 which is herein incorporated by reference in its entirety.

The present invention claims the priority of the Chinese Patent Application No. 201310244013.9, entitled "METHOD AND ELECTRONIC DEVICE FOR PROCESSING INFORMATION", filed with the Chinese Patent Office on Jun. 19, 2013 which is herein incorporated by reference in its entirety.

FIELD OF THE INVENTION

The present invention relates to the field of electronic technology, and in particular relates to method of displaying on an electronic device and electronic device.

BACKGROUND OF THE INVENTION

With the development of computer technology, more and more electronic devices are popularized in daily life of people, such as a tablet computer, a smart mobile phone, an electronic reading, a smart television, etc., which facilitate daily life of people.

However, most electronic devices include a display device, feeling of human's eyes to a luminous body or white reflector will be affected by color temperature of the display device. Customarily, the color temperature of the display device is generally set to 5000 K, 6500 K, 9300 K, and K is Kelvin temperature unit. Users can manually adjust the color temperature of the display device, such as 9000 K, 8000 K, etc., by means of screen menu of the display device, and so on.

The inventor of the present invention has found that at least the following technical problems exist in the prior art.

In the prior art, users can only manually adjust the color temperature of the display device, and users can not determine how to achieve a better display effect when they adjust the color temperature, therefore, many times of adjustments may be needed. Even if many times of adjustments are performed, it is possible that the color temperature of the display device can not be adjusted to the best effect, and the display device can not be in the best display status.

SUMMARY OF THE INVENTION

Embodiments of the present invention provide a method of displaying on an electronic device and an electronic device, to solve the problem that the display effect of electronic devices in the prior art is not well.

A method of displaying on an electronic device, comprising:

acquiring a first environment light parameter of an environment around the electronic device by the electronic device which comprises a display unit, wherein the first environment light parameter comprises at least a second color temperature value of the environment;

determining a first display parameter of the display unit according to the first environment light parameter; and displaying on the display unit with the first display parameter.

Before the determining a first display parameter of the display unit according to the first environment light parameter, the method further comprises:

determining a difference between the first color temperature value of the display unit and the second color temperature value of the environment around the electronic device being not less than a first preset threshold.

The acquiring the first environment light parameter of an environment around the electronic device comprises:

in a state that the display state of the display unit is a first display state, acquiring a first environment light parameter of the environment around the electronic device for adjusting the display state;

the determining the first display parameter of the display unit according to the first environment light parameter comprises:

judging, whether the display state needs to be adjusted and obtaining a first judgment result according to at least the second color temperature value of the environment in the first environment light parameter; and if the first judgment result indicates that the display state needs to be adjusted, acquiring a first display parameter of a second display state.

The determining the first display parameter of the display unit according to the first environment light parameter comprises:

determining a first reflection parameter of a target to be simulated; and determining the first display parameter of the display unit based on the first environment light parameter and the first reflection parameter, wherein the first display parameter is a display parameter with which the display unit displays the target to be simulated.

The first environment light parameter comprises an environment tristimulus value of the environment.

The determining the first display parameter of the display unit based on the first environment light parameter and the first reflection parameter comprises:

determining a first tristimulus value of the target to be stimulated based on the first reflection parameter and the environment tristimulus value; and determining the first display parameter of the display unit based on the first tristimulus value.

The acquiring the first environment light parameter of the environment around the electronic device for adjusting the display state in a state that the display state of the display unit is a first display state comprises:

acquiring the first environment light parameter of the environment around the electronic device for adjusting the display state by an environment detection apparatus in the electronic device, wherein the first environment light parameter further comprises a brightness parameter and a colorimetric parameter.

After acquiring the first environment light parameter of the environment around the electronic device for adjusting the display state, further comprising, simulating, a first state characteristic of the first target object corresponding to the first environment light parameter displayed on the display unit based on the first environment light parameter.

In the case where the first environment light parameter is the second color temperature value of the environment, the simulating, the first state characteristic of the first target object corresponding to the first environment light parameter displayed on the display unit based on the first environment light parameter comprises:

simulating a first color temperature characteristic of the first target object corresponding to the second color temperature value of the environment displayed on the display unit; or in the case where the first environment light parameter is a brightness parameter, the simulating the first state characteristic of the first target object corresponding to the first environment light parameter displayed on the display unit based on the first environment light parameter comprises:

simulating a first brightness characteristic of the first target object corresponding to the brightness parameter displayed on the display unit; or in the case where the first environment light parameter is a colorimetric parameter, the simulating the first state characteristic of the first target object corresponding to the first environment light parameter displayed on the display unit based on the first environment light parameter comprises:

simulating a first colorimetric characteristic of the first target object corresponding to the colorimetric parameter displayed on the display unit.

The electronic device further comprises an image collection module, and the method further comprising:

collecting an image by the image collection module while acquiring the second color temperature value of the environment; and performing white balance adjustment to the image according to the second color temperature value of the environment.

An electronic device, comprising:

a display unit;

a first acquisition module, configured to acquire a first environment light parameter of an environment around the electronic device, wherein the first environment light parameter comprising at least a second color temperature value of the environment; and a second determination module, configured to determine a first display parameter of the display unit based on the first environment light parameter so that the display unit displays with the first display parameter.

The second determination module comprises:

a first determination unit, configured to determine a difference between the first color temperature value of the display unit and the second color temperature value of the environment around the electronic device being not less than a first preset threshold; and a second determination unit, configured to determine the first display parameter of the display unit according to the first environment light parameter.

The second determination unit comprises:

a first determination sub-unit, configured to determine a first reflection parameter of a target to be simulated; and a second determination sub-unit, configured to determine the first display parameter based on the first environment light parameter and the first reflection parameter, wherein the first display parameter is a display parameter with which the display unit displays the target to be simulated.

The first environment light parameter is an environment tristimulus value of the environment.

The second determination sub-unit comprises:

a third determination sub-unit, configured to determine a first tristimulus value of the target to be simulated based on the first reflection parameter and the environment tristimulus value; and a fourth determination sub-unit, configured to determine the first display parameter based on the first tristimulus value.

The first acquisition module comprises a first acquisition unit, the first acquisition unit, configured to acquire, the first environment light parameter of the environment around the electronic device for adjusting the display state in the case where the display state of the display unit is a first display state;

the second determination module comprises:

a first judgment unit, configured to judge whether the display state needs to be adjusted, and to obtain a first judgment result based on at least the environment color temperature parameter in the first environment light parameter; and a first adjustment unit, configured to adjusting the display state from the first display state to a second display state different from the first display state if the first judgment result indicates that the display state needs to be adjusted, wherein the display parameter corresponding to the second display state is the first display parameter.

The electronic device further comprising:

a first simulation module, configured to simulate a first state characteristic of a first target object corresponding to the first environment light parameter displayed on the display unit based on the first environment light parameter.

The first simulation module comprises:

a color temperature simulation sub-unit, configured to simulate a first color temperature characteristic of the first target object corresponding to the color temperature parameter displayed on the display unit in the case where the first environment light parameter is a color temperature parameter;

a brightness simulation sub-unit, configured to simulate a first brightness characteristic of the first target object corresponding to the brightness parameter displayed on the display unit in the case where the first environment light parameter is a brightness parameter; and a colorimetric simulation sub-unit, configured to simulate a first colorimetric characteristic of the first target object corresponding to the colorimetric parameter displayed on the display unit in the case where the first environment light parameter is a colorimetric parameter.

The first judgment unit is configured to:

judge whether the first state characteristic matches the first display state, and obtain a first judgment result, wherein in the case that the first judgment result is negative, it indicates that the display state needs to be adjusted; and in the case that the first judgment result is positive, it indicates that the display state does not need to be adjusted.

The electronic device further comprising an image collection module and an adjustment module, wherein the image collection module is configured to collect an image while the first acquisition module acquires the second color temperature value of the environment; and the adjustment module is configured to perform white balance adjustment to the image according to the second color temperature value of the environment.

One or more technical solutions provided by the present invention at least have the following technical effects or advantages:

In the embodiments of the present invention, the first display parameter output by the display unit is determined by the first environment light parameter of the environment of the electronic device, and when the display unit displays with the first display parameter, the display unit has the most display effect.

BRIEF DESCRIPTION OF THE DRAWINGS

The accompany drawings needed to be used in the description of the embodiments or the prior art will be described briefly as follows, so that the technical solutions according to the embodiments of the present invention or according to the prior art will become more clearer. It is clear that the accompany drawings in the following description are only some embodiments of the present invention. For those skilled in the art, other accompany drawings may be obtained according to these accompany drawings without any creative work.

In the specification, claims and the drawings, terms "first", "second", "third", "fourth", etc. (if exists) are used to distinguish between similar parts, without the meaning of necessarily describing a particular order or sequence. It should be understood that data used in such a way are interchangeable under appropriate circumstances, so that the embodiments of the invention described herein can be implemented in an order other than the orders illustrated herein.

DETAILED DESCRIPTION OF THE INVENTION

In order to make objects, technical solutions and advantages of embodiments of the present invention become clearer, hereinafter technical solutions in embodiments of the present invention will be described clearly and completely in conjunction with the accompanying drawings of the embodiments of the present invention. Obviously, the described embodiments are a part of the embodiments of the present invention, but not all embodiments. Based on the embodiments in the present invention, all other embodiments obtained by those skilled in the art without creative work will be falling within the scope of protection of the present invention.

In order to improve the display effect of a display device and to render users can see more true colors, the present invention provides a method of displaying on an electronic device, the method is applied in the electronic device with a display unit and includes:

acquiring a first environment light parameter of an environment around the electronic device;

Here, the first environment light parameter includes at least a second color temperature value of the environment.

determining a first display parameter of the display unit according to the first environment light parameter; and displaying, by the display unit, with the first display parameter.

An embodiment of the present invention provides a method of displaying on an electronic device, which is applied to an electronic device with a display unit, such as a notebook computer, a tablet computer, a liquid crystal television, etc.

Figure 1:
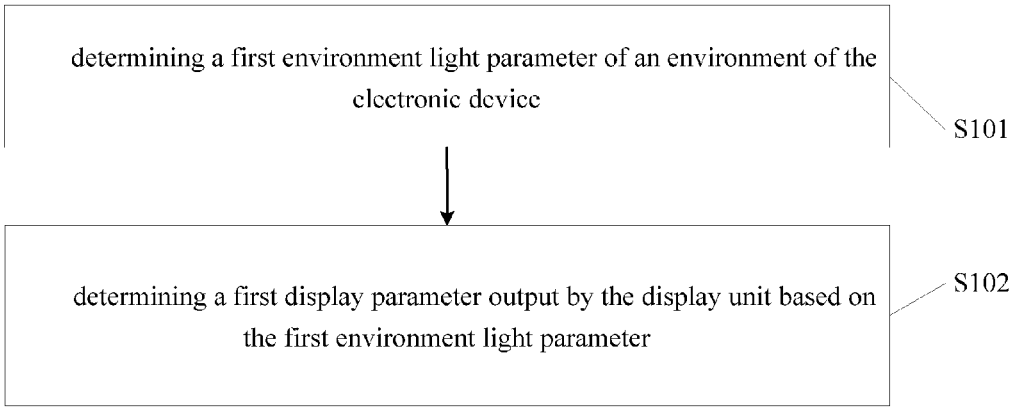
FIG. 1 is a flowchart of a method of displaying on an electronic device in an embodiment of the present invention.

Referring to FIG. 1, the method for electronic display includes the following steps:

Step S101: determining a first environment light parameter of an environment of the electronic device;

Here, the first environment light parameter includes at least a second color temperature value of the environment.

Step S102: determining a first display parameter output by the display unit based on the first environment light parameter, wherein when the display unit displays with the first display parameter, a color temperature difference between a first color temperature value of the display unit and a second color temperature value of the environment is less than a first preset threshold.

Here, in step S101, the first environment light parameter includes: for example, an environment tristimulus value $X_0Y_0Z_0$ of the environment, an environment light intensity of the environment, color temperature of the environment light of the environment (which is the second color temperature value of the environment in the present invention), and so on. The first environment light parameter can be captured by a variety of sensors, such as a light sensor, a color temperature meter, etc.

In step S102, the determining a first display parameter of the display unit based on the first environment light parameter may include a variety of determination cases, two cases of which will be described hereinafter. Of course, the specific implementation process is not limited in the following two cases.

A first case: a first color temperature value of the environment light is determined directly based on the first environment light parameter, and then the first color temperature value is adjusted to the first display parameter.

For example, the first environment light parameter is set as a second color temperature value collected by the color temperature meter, which is assumed to be 6000 K, and of course, which may also be other values, such as 5000 K, 10000 K, etc. Further, the first display parameter is determined a first color temperature value which is same as or similar with the second color temperature value, and then, the first color temperature value is output by the display unit. In this case, the color temperature of the environment and the color temperature output by the display unit are ensured approximately the same, and thus, the display unit can be ensured to achieve the best output effect.

Figure 2:
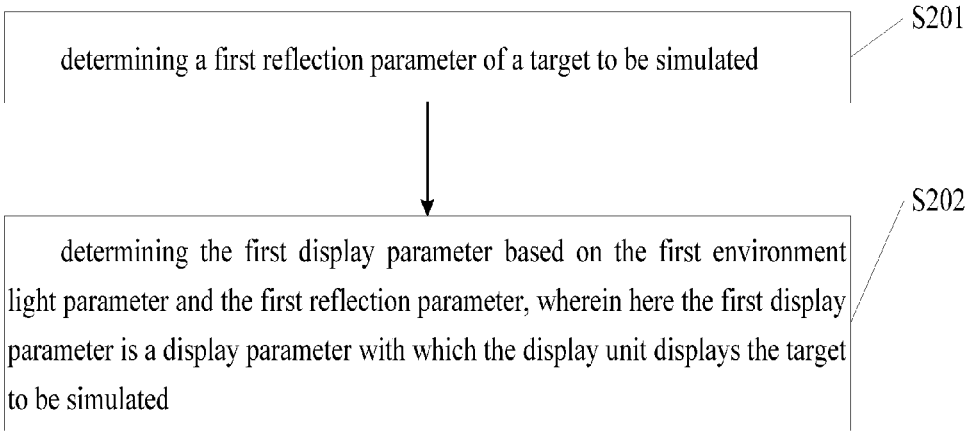
FIG. 2 is a flowchart of a method of displaying on an electronic device according to an embodiment of the present invention, in which a first display parameter is determined by a first environment light parameter.

A second case: referring to FIG. 2, the determining a first display parameter of the display unit based on the first environment light parameter includes the following steps:

Step S201: determining a first reflection parameter of a target to be simulated;

Step S202: determining the first display parameter based on the first environment light parameter and the first reflection parameter, where the first display parameter is a display parameter with which the display unit displays the target to be simulated.

In step S201, the target to be simulated is for example paper, rock, etc. The color temperature adjustment performed in the first case is only a adjustment of display color temperature of the display unit, while in the present case, in addition to the color temperature adjustment, display effects of the display unit will be simulated to the target to be simulated. Thus, output control of the display unit becomes more precise, and also experience of users will be better.

When the first environment optical parameter is an environment tristimulus value of the environment, the determining the first display parameter based on the first environment light parameter and the first reflection parameter includes: determining a first tristimulus value of the target to be simulated based on the first reflection parameter and the environment tristimulus value; and determining the first display parameter based on the first tristimulus value.

In a specific implementation process, the first reflection parameter f(X), f(Y), f(Z) (different reflection parameters are existed in different color space) may be a parameter prestored in the electronic device, also, the target to be simulated can be displayed on the display unit of the electronic device, and then its corresponding reflection parameter can be captured by a sensor as the first reflection parameter f(X), f(Y), f(Z). The first reflection parameter is, for example, f(X)=50%, f(Y)=55%, f(Z)=60%. Of course, this is only an example and not to be interpreted as limitation.

After the first reflection parameter f(X), f(Y), f(Z) is determined, the first tristimulus value X, Y, Z can be obtained by calculating the following formulae [1]:

$$X=f(X)*X_0/p_i;$$

$$Y=f(Y)*Y_0/p_i;$$

$$Z=f(Z)*Z_0/p_i. \quad [1]$$

In the above formulae [1], $p_i$ refers to the ratio of the circumference, i.e., 3.1416, and each formula of the formulae [1] is divided by $p_i$ since the first tristimulus value is represented by illumination, the unit of which is lux, however, subsequent calculations are performed in luminance, thus it is necessary to convert the illumination unit into luminance unit, i.e., nit. Thus, this conversion is achieved by each formula dividing $p_i$.

Before the determining the first display parameter based on the first tristimulus value, the method further includes: determining a second reflection parameter of the display unit of reflecting environment light of the environment; and determining a second tristimulus value of the display unit of reflecting the environment light based on the second reflection parameter and the environment tristimulus value.

In a specific implementation process, the second reflection parameter $f_1(X)$, $f_1(Y)$, $f_1(Z)$ can be obtained by a collection of a variety of sensors, such as a RGB sensor, a spectrograph, a spectrometer, etc. The second reflection parameter $f_1(X)$, $f_1$, (Y), $f_1(Z)$ is $f_1(X)=f_1(Y)=f_1(Z)=4\%$, for example. Of course, the is only and example and not to be interpreted as limitation.

After the second reflection parameter $f_1(X)$, $f_1(Y)$, $f_1(Z)$ is obtained, the second tristimulus value $X_1$, $Y_1$, $Z_1$ can be obtained by calculating the following formulae [2]:

$$X_1=f_1(X)*X_0/p_i$$

$$Y_1=f_1(Y)*Y_0/p_i$$

$$Z_1=f_1(Z)*Z_0/p_i \quad [2]$$

The use of $p_i$ in the above formulae [2] is same as the use in the above formulae [1].

In a specific implementation process, there is no sequence between the step of calculating the first tristimulus value and the step of calculating the second tristimulus value. It is possible to calculate the first tristimulus value firstly and then calculate the second tristimulus value, or calculate the second tristimulus value firstly and then calculate the first tristimulus value, and or simultaneously calculate both of them, which is not restricted in the embodiments of the present invention.

Figure 3:
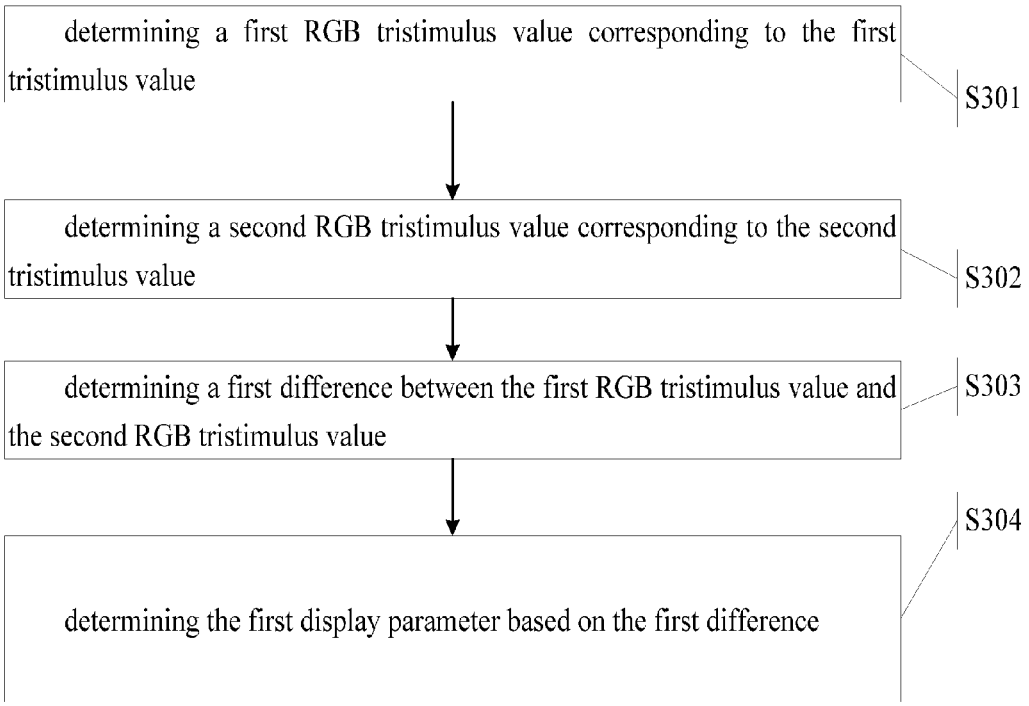
FIG. 3 is a flowchart of a method of displaying on an electronic device according to an embodiment of the present invention, in which a first display parameter is determined by a first tristimulus value and a second tristimulus value.

After the first tristimulus value and the second tristimulus value are obtained, the first display parameter can be determined based on the first tristimulus value and the second tristimulus value. Referring to FIG. 3, the method further includes the following steps:

Step S301: determining a first RGB tristimulus value corresponding to the first tristimulus value;

Step S302: determining a second RGB tristimulus value corresponding to the second tristimulus value;

Step S303: determining a first difference between the first RGB tristimulus value and the second RGB tristimulus value;

Step S304: determining the first display parameter based on the first difference.

Here, there is no sequence between step S301 and step S302. It is possible to perform step S301 firstly, or perform step S302 firstly, or simultaneously perform both of them, which is not restricted in the embodiments of the present invention.

Specifically, in step S301, the determining a first RGB stimulus value corresponding to the first tristimulus value includes mapping the first tristimulus value to the first RGB stimulus value based on a first mapping matrix.

Assuming that the first mapping matrix T is:

$$T=\begin{pmatrix} T_{11} & T_{12} & T_{13} \\ T_{21} & T_{22} & T_{23} \\ T_{31} & T_{32} & T_{33} \end{pmatrix} \quad [3]$$

After the first mapping matrix T described above is determined, the first RGB tristimulus value can be determined by the following formulae [4]:

$$r_1=T_{11}*X+T_{12}*Y+T_{13}*Z$$

$$g_1=T_{21}*X+T_{22}*Y+T_{23}*Z$$

$$b_1=T_{31}*X+T_{32}*Y+T_{33}*Z \quad [4]$$

In step S302, the determining a second RGB tristimulus value corresponding to the second tristimulus value includes mapping the second tristimulus value to the second RGB stimulus value based on the first mapping matrix.

The second tristimulus value can be mapped to the second RGB tristimulus value by the following formulae [5]:

$$r=T_{11}*X_1+T_{12}*Y_1+T_{13}*Z_1$$

$$g_2=T_{21}*X_1+T_{22}*Y_1+T_{23}*Z_1$$

$$b=T_{31}*X_1+T_{32}*Y_1+T_{33}*Z_1 \quad [5]$$

Before the determining the first RGB stimulus value or the second RGB stimulus value based on step S301 or step S302, the method further includes:

calibrating the first mapping matrix.

Depending on the different application environments, there may be a bias error in a conversion of the tristimulus value to the RGB tristimulus value based on the first mapping matrix. For example, the original first mapping matrix T can convert a tristimulus value of 0.5 to a RGB tristimulus value of 127, however, it may only be converted to 125 as affected by the environment. Therefore, in order to achieve a more accurate conversion of the tristimulus value to the RGB tristimulus value, so as to achieve a more precise control to the color temperature of the display device, it is necessary to do a calibration to the first mapping matrix T.

In step S303, after the first RGB tristimulus value and the second RGB tristimulus value are determined based on step S301 and step S302, the first difference can be determined based on the following formulae [6]:

$$r=r_1-r_2$$

$$g=g_1-g_2$$

$$b=b_1-b_2$$

In step S304, the determining the first display parameter based on the first difference includes: converting the first difference to an RGB grayscale value according to a first preset rule, here the RGB grayscale value is the first display parameter.

Further, the first preset rule is defined by the following equations:

$$R=((r-L_{leakage})/(L_{red\ max}-L_{leakage}))\hat{}(1/\text{red gamma})*255$$

$$G=((r-L_{leakage})/(L_{green\ max}-L_{leakage}))\hat{}(1/\text{green gamma})*255$$

$$B=((r-L_{leakage})/(L_{blue\ max}-L_{leakage}))\hat{}(1/\text{blue gamma})*255 \quad [7]$$

where, R represents red component in the RGB grayscale value;

G represents green component in the RGB grayscale value;

B represents blue component in the RGB grayscale value;

$L_{leakage}$ represents a light leakage value of the display unit;

$L_{red\ max}$ represents the display highest light intensity of the red component;

$L_{green\ max}$ represents the display highest light intensity of the green component;

$L_{blue\ max}$ represents the display highest light intensity of the blue component;

red gamma represents a red gamma value determined according to the red component in the first difference;

green gamma represents a green gamma value determined according to the green component in the first difference;

blue gamma represents a blue gamma value determined according to the blue component in the first difference.

The gamma value is obtained by a look-up table. Referring to Table 1, in table 1, the first column is a grayscale value, the second column is a red luminance value corresponding to the grayscale, the third column is a green luminance value corresponding to the grayscale, the fourth column is a blue luminance value corresponding to the grayscale, the fifth column is a red gamma value corresponding to the grayscale, the sixth column is a green gamma value corresponding to the grayscale, and the seventh column is a blue gamma value corresponding to the grayscale.

Taking calculating the red gamma as example, according to the r value calculated above, red luminance value corresponding to the red gamma can be found in the second column firstly, and then the corresponding red gamma value in the fifth column is found, which is the gamma value for calculating the grayscale. The gamma value can be obtained with a linear interpolation method. The method is similar to the color temperature difference method described above (for one which has no gamma value, such as 0 and 255, taking the adjacent grayscale gamma value).

The methods of calculating the green gamma and the blue gamma are same as the methods of calculating the red gamma.

TABLE 1

| Grayscale | R | G | B | R_gamma | G_gamma | B_gamma |
|---|---|---|---|---|---|---|
| 0 | 0.3296 | 0.3294 | 0.329 | #NUM! | #NUM! | #NUM! |
| 7 | 0.3341 | 0.3412 | 0.3325 | 2.668302 | 2.661186 | 2.649069 |
| 15 | 0.3707 | 0.4359 | 0.3591 | 2.605367 | 2.613525 | 2.602196 |
| 23 | 0.4752 | 0.7106 | 0.4355 | 2.542515 | 2.549234 | 2.539294 |
| 31 | 0.6844 | 1.259 | 0.5886 | 2.479985 | 2.487672 | 2.476162 |
| 39 | 1.02 | 2.142 | 0.8353 | 2.428658 | 2.436335 | 2.423159 |
| 47 | 1.495 | 3.392 | 1.184 | 2.387032 | 2.395058 | 2.380676 |
| 55 | 2.112 | 5.008 | 1.637 | 2.354639 | 2.364281 | 2.347464 |
| 63 | 2.875 | 7.028 | 2.199 | 2.328487 | 2.337249 | 2.31982 |
| 71 | 3.804 | 9.472 | 2.884 | 2.302853 | 2.312519 | 2.292609 |
| 79 | 4.895 | 12.37 | 3.688 | 2.27963 | 2.288263 | 2.26802 |
| 87 | 6.159 | 15.7 | 4.614 | 2.256834 | 2.266469 | 2.245048 |
| 95 | 7.609 | 19.53 | 5.667 | 2.232929 | 2.243074 | 2.222528 |
| 103 | 9.258 | 23.86 | 6.863 | 2.206838 | 2.218807 | 2.197738 |
| 111 | 11.05 | 28.64 | 8.165 | 2.185393 | 2.19601 | 2.17692 |
| 119 | 13.01 | 33.81 | 9.587 | 2.164635 | 2.17646 | 2.156896 |
| 127 | 15.15 | 39.51 | 11.13 | 2.142961 | 2.154074 | 2.137077 |
| 135 | 17.42 | 45.5 | 12.76 | 2.124716 | 2.137288 | 2.121345 |
| 143 | 19.77 | 51.72 | 14.46 | 2.113449 | 2.126977 | 2.110882 |
| 151 | 22.28 | 58.37 | 16.24 | 2.101262 | 2.115709 | 2.103757 |
| 159 | 24.93 | 65.43 | 18.14 | 2.089616 | 2.103922 | 2.094865 |
| 167 | 27.72 | 72.82 | 20.24 | 2.078154 | 2.0939 | 2.074499 |

TABLE 1-continued

| Grayscale | R | G | B | R_gamma | G_gamma | B_gamma |
|---|---|---|---|---|---|---|
| 175 | 30.63 | 80.46 | 22.29 | 2.068254 | 2.087998 | 2.072041 |
| 183 | 33.67 | 88.52 | 24.46 | 2.058737 | 2.080438 | 2.067193 |
| 191 | 36.88 | 97.51 | 26.72 | 2.045468 | 2.052569 | 2.063469 |
| 199 | 40.53 | 106.7 | 29.17 | 2.000072 | 2.027816 | 2.046902 |
| 207 | 44.07 | 116.6 | 31.83 | 1.97339 | 1.984341 | 2.010723 |
| 215 | 48.17 | 127 | 34.63 | 1.886833 | 1.923244 | 1.958503 |
| 223 | 52.21 | 137.8 | 37.49 | 1.796316 | 1.837061 | 1.894861 |
| 231 | 56.3 | 148.7 | 40.44 | 1.669158 | 1.720173 | 1.797693 |
| 239 | 60.33 | 159.5 | 43.39 | 1.473165 | 1.539642 | 1.647028 |
| 247 | 63.9 | 169.3 | 46.09 | 1.181619 | 1.255546 | 1.440396 |
| 255 | 66.34 | 176.2 | 48.24 | #DIV/0! | #DIV/0! | #DIV/0! |

Hereinafter, the method of displaying on an electronic device in the present invention is described according to several embodiments. It should be noted that the embodiments of the present invention are intended for purposes of illustration only, and not intended to limit the present invention. All embodiments coinciding with the idea of the present invention fall within the scope of the present invention, and those skilled in the art naturally know how to make modifications according to the idea of the present invention.

First Embodiment

Figure 4:
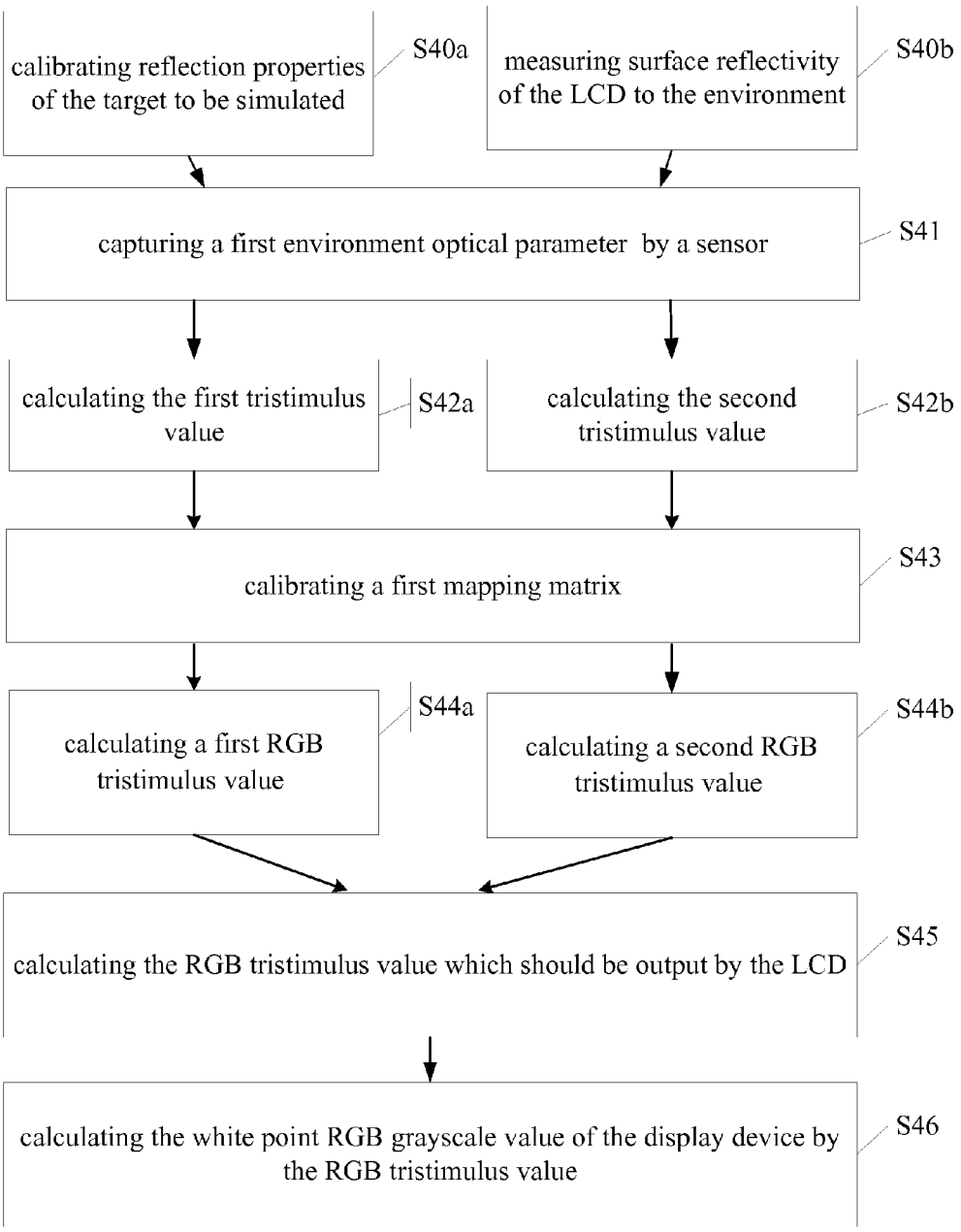
FIG. 4 is a flowchart of a method of displaying on an electronic device in the first embodiment of the present invention.

In the present embodiment, taking example for the electronic device as a liquid crystal television including a liquid crystal display (LCD). Referring to FIG. 4, the method of displaying on an electronic device includes the following steps:

Step S40*a*: calibrating reflection properties of the target to be simulated, i.e., the first reflection parameter f(X), f(Y), f(Z);

Step S40*b*: measuring surface reflectivity of the LCD to the environment, i.e., the second reflection parameter $f_1(X)$, $f_1(Y)$, $f_1(Z)$;

Step S41: capturing a first environment optical parameter $X_0Y_0Z_0$ by a sensor, which is a light sensor, for example.

Step S42*a*: calculating the tristimulus value of the target to be simulated by the first environment optical parameter $X_0Y_0Z_0$ and the first reflection parameter f(X), f(Y), f(Z), which is the first tristimulus value X, Y, Z which is obtained mainly by calculating the above formulae [1].

Step S42*b*: calculating the tristimulus value of the LCD surface reflection by the first environment optical parameter $X_0Y_0Z_0$ and the second reflection parameter $f_1(X)$, $f_1(Y)$, $f_1(Z)$, which is, the second tristimulus value $X_1$, $Y_1$, $Z_1$ which is obtained mainly by calculating the above formulae [2].

Step S43: calibrating a mapping matrix of the LCD from the tristimulus value XYZ to the RGB tristimulus value rgb output by the LCD, i.e., the first mapping matrix T;

Step S44*a*: calculating a first RGB tristimulus value $r_1g_1b_1$ which should be output from the target to be simulated on the LCD, which obtained mainly by calculating the formulae [4] by the first mapping matrix T obtained above.

Step S44*b*: calculating a second RGB tristimulus value $r_2g_2b_2$ of the LCD surface reflection of the environment light, which is obtained mainly by calculating the formulae [5] by the first mapping matrix T obtained above.

Step S45: calculating the RGB tristimulus value which should be output by the LCD, which is obtained mainly by calculating the above formulae [6].

Step S46: calculating the white point RGB grayscale value of the display device by the RGB tristimulus value according to the gamma, which is obtained mainly by calculating the above formulae [7], and the other intermediate grayscales are remapped according to the same scale.

Second Embodiment

In the present embodiment, the determination of the collection process of the first mapping matrix T will be described, which includes:

1) inputting a parameter matrix A of the display unit, and the matrix is set to a variable and can be input manually. Its default value is:

$$A = \begin{pmatrix} 0.5904 & 0.3515 & 66.34 \\ 0.3358 & 0.56 & 176.2 \\ 0.1557 & 0.1222 & 48.24 \end{pmatrix} \quad [8]$$

Setting a matrix B as:

$$B = \begin{pmatrix} a_{13} & 0 & 0 \\ 0 & a_{23} & 0 \\ 0 & 0 & a_{33} \end{pmatrix} \quad [9]$$

2) calculating a changed matrix C of the parameter matrix A:

$$C = \begin{pmatrix} a_{11} * a_{13} / a_{12} & a_{13} & (1 - a_{11} - a_{12}) * a_{13} / a_{12} \\ a_{21} * a_{23} / a_{22} & a_{23} & (1 - a_{21} - a_{22}) * a_{23} / a_{22} \\ a_{31} * a_{33} / a_{32} & a_{33} & (1 - a_{31} - a_{32}) * a_{33} / a_{32} \end{pmatrix} \quad [10]$$

3) calculating the transposed matrix D of the matrix C:

$$D = \text{transpose}(C) \quad [11]$$

4) calculating the inverse matrix E of the matrix D:

5) calculating the mapping matrix T (i.e., the first mapping matrix) from the tristimulus value XYZ to the RGB tristimulus value rgb, which is as follows:

$$T = B * E \quad [12]$$

Third Embodiment

The third embodiment of the present invention describes the selection process of the parameter matrix A in the second embodiment, which includes the following steps:

1) setting a backlight brightness Y according to the $E_v$ value of the environment light as:

$$Y=E_v*f_1/p_i$$

where $E_v$ refers to the environment light intensity value; $f_1$ refers to the average emission rate of the LCD surface; $p_i$ refers to the ratio of the circumference, i.e., 3.1416.

2) Selecting the parameter matrix A.

After the backlight brightness is calculated by the above formulae, the corresponding parameter matrix A can be determined by the following Table 2, which includes: firstly, determining the corresponding row by the first column Y, and then reading the matrix in the third column

| Y | Backlight | x | y | Y | $L_{leakage}$ |
|---|---|---|---|---|---|
| 4.769 | 10 | 0.5907 | 0.3523 | 1.114 | 0.00755 |
| | | 0.3394 | 0.5619 | 2.906 | |
| | | 0.1569 | 0.123 | 0.7753 | |
| 9.18 | 15 | 0.5906 | 0.3522 | 2.143 | 0.01234 |
| | | 0.3393 | 0.5619 | 5.591 | |
| | | 0.1569 | 0.1229 | 1.491 | |
| 15.77 | 25 | 0.5905 | 0.3522 | 4.955 | 0.01945 |
| | | 0.3392 | 0.5618 | 12.94 | |
| | | 0.1568 | 0.1229 | 3.453 | |
| 21.24 | 35 | 0.5905 | 0.3521 | 6.293 | 0.02539 |
| | | 0.3392 | 0.5617 | 16.47 | |
| | | 0.1569 | 0.1229 | 4.381 | |
| 27.8 | 45 | 0.5905 | 0.3521 | 6.486 | 0.03246 |
| | | 0.339 | 0.5617 | 16.94 | |
| | | 0.1568 | 0.1228 | 4.521 | |
| 32.18 | 50 | 0.5905 | 0.3521 | 7.503 | 0.03724 |
| | | 0.3389 | 0.5617 | 19.59 | |
| | | 0.1568 | 0.1228 | 5.233 | |
| 40.87 | 59 | 0.5905 | 0.352 | 9.534 | 0.04668 |
| | | 0.3386 | 0.5615 | 24.89 | |
| | | 0.1567 | 0.1228 | 6.635 | |
| 49.61 | 63 | 0.5905 | 0.352 | 11.58 | 0.05615 |
| | | 0.3384 | 0.5614 | 30.21 | |
| | | 0.1566 | 0.1227 | 8.04 | |
| 60.67 | 67 | 0.5905 | 0.352 | 14.11 | 0.0684 |
| | | 0.338 | 0.5612 | 36.95 | |
| | | 0.1565 | 0.1227 | 9.903 | |
| 69.4 | 70 | 0.5904 | 0.3515 | 16.13 | 0.07777 |
| | | 0.3358 | 0.56 | 42.27 | |
| | | 0.1557 | 0.1222 | 11.34 | |
| 80.26 | 75 | 0.5905 | 0.352 | 18.65 | 0.08972 |
| | | 0.338 | 0.5612 | 48.86 | |
| | | 0.1565 | 0.1227 | 13.14 | |
| 134.9 | 87 | 0.5905 | 0.352 | 31.22 | 0.1489 |
| | | 0.338 | 0.5612 | 82.09 | |
| | | 0.1565 | 0.1227 | 22.2 | |
| 151 | 89 | 0.5905 | 0.352 | 34.93 | 0.1665 |
| | | 0.338 | 0.5612 | 91.9 | |
| | | 0.1565 | 0.1227 | 24.91 | |

Table 2

Taking example for backlight brightness of 9.18, the corresponding parameter matrix A is:

$$A=\begin{pmatrix} 0.5906 & 0.3522 & 2.143 \\ 0.3393 & 0.5619 & 5.591 \\ 0.1569 & 0.1229 & 1.491 \end{pmatrix} \quad [13]$$

3) determining whether the parameter matrix A obtained in 2) is appropriate, which includes the following steps:

S1, calculating the r, g, b value by the above formulae [4], [5], [6];

S2, determining whether the r, g, b obtained in step S1 exceeds its maximum value, for example, if the maximum of r, g, b is 1 while the calculated r is 1.2, showing that the maximum value is exceeded, the parameter matrix A is determined inappropriate, therefore a next parameter matrix A will be selected to repeat the calculation of the r, g, b value; if no selected parameter matrix A satisfies the conditions, the r, g, b will be set to be its maximum. For example, if previously calculated r is 1.2, r will be set to be 1.

An embodiment of the present invention provides an electronic device having a display unit. The electronic device further includes:

a first acquisition module, configured to acquire a first environment light parameter of an environment around the electronic device, and the first environment light parameter including at least a second color temperature value of the environment; and a second determination module, configured to determine a first display parameter of the display unit based on the first environment light parameter so that the display unit displays with the first display parameter.

Figure 5:
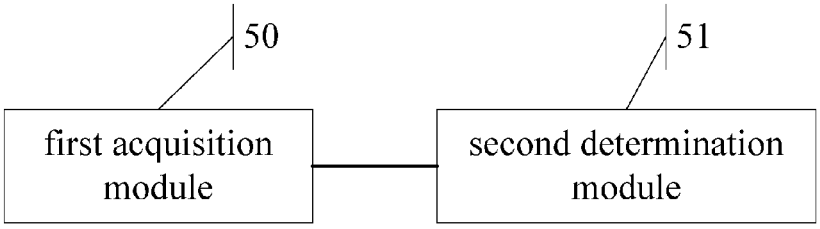
FIG. 5 is a structure diagram of an electronic device in an embodiment of the present invention.

Referring to FIG. 5, in one embodiment of the present invention, the electronic device includes a display unit, and further includes:

a first acquisition module 50, configured to determine a first environment light parameter of an environment of the electronic device, and the first environment light parameter including at least a second color temperature value of the environment;

a second determination module 51 includes:

a first determination unit, configured to determine a color temperature difference between a first color temperature value of the display unit and a second color temperature value of the environment is less than a first preset threshold; and a second determination unit, configured to determine a first display parameter of the display unit according to the first environment light parameter.

Optionally, the second determination unit includes:

a first determination sub-unit, configured to determine a first reflection parameter of a target to be simulated;

a second determination sub-unit, configured to determine the first display parameter based on the first environment light parameter and the first reflection parameter, wherein the first display parameter is a display parameter with which the display unit displays the target to be simulated.

Optionally, the first environment light parameter is an environment tristimulus value of the environment.

Optionally, the second determination sub-unit includes:

a third determination sub-unit, configured to determine a first tristimulus value of the target to be simulated based on the first reflection parameter and the environment tristimulus value;

a fourth determination sub-unit, configured to determine the first display parameter based on the first tristimulus value.

Optionally, second determination unit further includes:

a fifth determination sub-unit, configured to determine a second reflection parameter of the display unit when reflecting environment light of the environment before determining the first display parameter based on the first tristimulus value;

a sixth determination sub-unit, configured to determine a second tristimulus value of the display unit when reflecting the environment light based on the second reflection parameter and the environment tristimulus value.

Optionally, the fourth determination sub-unit is configured to determine the first display parameter based on the first tristimulus value and the second tristimulus value.

Optionally, the fourth determination sub-unit is configured to:

determine a first RGB tristimulus value corresponding to the first tristimulus value;

determine a second RGB tristimulus value corresponding to the second tristimulus value;

determine a first difference between the first RGB tristimulus value and the second RGB tristimulus value; and determine the first display parameter based on the first difference.

Optionally, the fourth determination sub-unit is configured to map the first tristimulus value to the first RGB tristimulus value based on a first mapping matrix; or the fourth determination sub-unit is configured to map the second tristimulus value to the second RGB tristimulus value based on the first mapping matrix.

Optionally, the electronic device further includes:

a calibration module, configured to calibrate the first mapping matrix before determining a first RGB tristimulus value corresponding to the first tristimulus value or determining a second RGB tristimulus value corresponding to the second tristimulus value.

Optionally, the fourth determination sub-unit is configured to convert the first difference to an RGB grayscale value according to a first preset rule, wherein the RGB grayscale value is the first display parameter.

Optionally, the first preset rule is defined by the following equations:

$$R=((r-L_{leakage})/(L_{red\ max}-L_{leakage}))\hat{}(1/\text{red gamma})*255$$

$$G=((r-L_{leakage})/(L_{green\ max}-L_{leakage}))\hat{}(1/\text{green gamma})*255$$

$$B=((r-L_{leakage})/(L_{blue\ max}-L_{leakage}))\hat{}(1/\text{blue gamma})*255$$

where, R represents red component in the RGB grayscale value;

G represents green component in the RGB grayscale value;

B represents blue component in the RGB grayscale value;

$L_{leakage}$ represents a light leakage value of the display unit;

$L_{red\ max}$ represents the display highest light intensity of the red component;

$L_{green\ max}$ represents the display highest light intensity of the green component;

$L_{blue\ max}$ represents the display highest light intensity of the blue component;

red gamma represents a red gamma value determined according to the red component in the first difference;

green gamma represents a green gamma value determined according to the green component in the first difference;

blue gamma represents a blue gamma value determined according to the blue component in the first difference.

The above electronic device is used to execute the method of displaying on an electronic device described above, and therefore, based on the method presented by embodiments of the present invention, those skilled in the art can understand special structures and variations of the electronic device presented by embodiments of the present invention, therefore, which will be not described in detail here.

One or more technical solutions provided by the present application at least have the following technical effects or advantages:

(1) In the embodiments of the present invention, the first display parameter output by the display unit is determined by the first environment light parameter of the environment of the electronic device, and when the display unit displays with the first display parameter, it can ensure that the color temperature difference between the first color temperature value of the display unit and the second color temperature value of the environment is small, thus the display device has the best display effect. Since the color temperature of the display device can be adjusted to the best display effect directly based on the first environment light parameter, there is a technical effect that adjustment on the color temperature of the display device is more accurate.

(2) In the embodiments of the present invention, a first reflection parameter of a target to be simulated can be determined, and then the first display parameter can be determined by the first reflection parameter and the first environment light parameter, and thereby output of the display unit can be simulated to the target to be simulated. Thus, the technical effect that display control of the display unit is more precise is achieved.

(3) In the embodiments of the present invention, the first display parameter can be determined by the first tristimulus value of the display unit when reflecting the target to be simulated and the second tristimulus value of the display unit when reflecting the environment, and thus, the influence of the display unit reflecting the environment light can be excluded. Thus, a technical effect of preventing disturbance of the environment light when the display unit displays is achieved.

(4) In the embodiments of the present invention, when the first RGB tristimulus value is determined by the first tristimulus value, or the second RGB tristimulus value is determined by the second tristimulus value, the first mapping matrix is needed to be calibrated firstly, and then the technical effect that the display control of the display unit is more precise can be achieved.

Further, an embodiment of the present invention provides a method of displaying on an electronic device, which is applied to an electronic device having a display unit, such as an intelligent television, a tablet computer, a notebook computer, and a smart phone which we often use, and the method includes:

acquiring a first environment light parameter of an environment around the electronic device;

Here, the first environment light parameter includes at least a second color temperature value of the environment.

determining a first display parameter of the display unit according to the first environment light parameter; and displaying, by the display unit, with the first display parameter.

Figure 6:
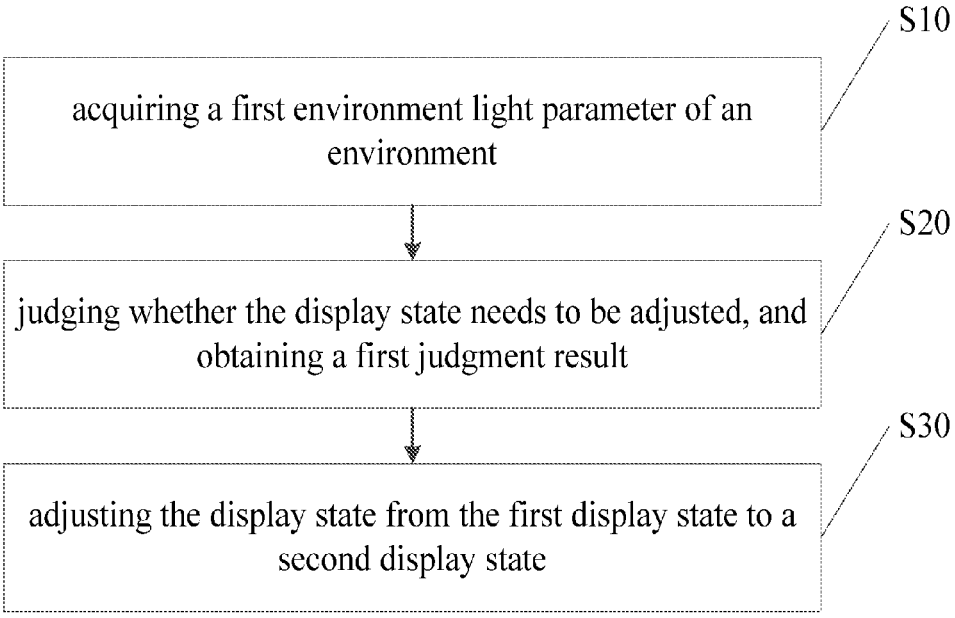
FIG. 6 is a flow chart of a method of displaying on an electronic device in an embodiment of the present invention.
Figure 7:
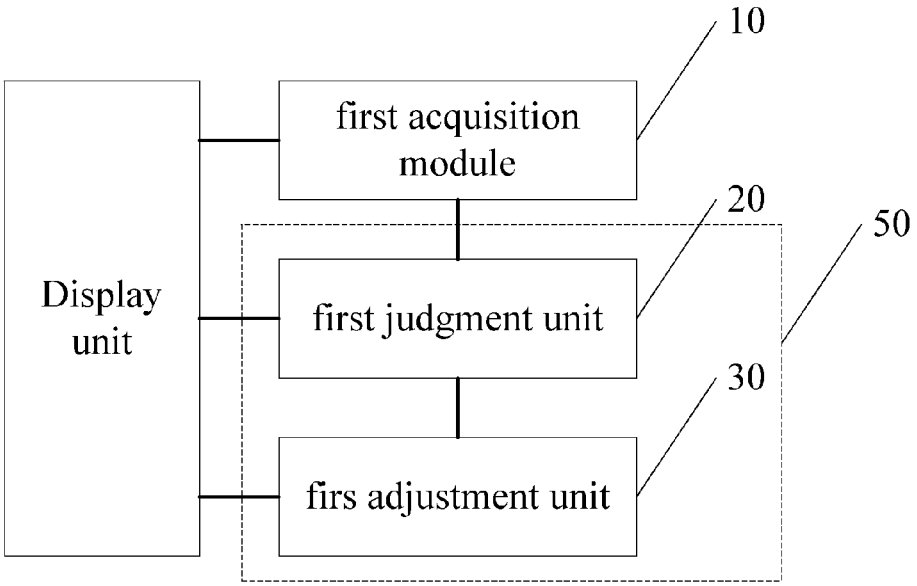
FIG. 7 is a module diagram of an electronic device in an embodiment of the present invention.

Referring to FIG. 6, in an embodiment of the present invention, the step of acquiring a first environment light parameter of an environment around the electronic device includes:

S10, in the case where the display state of the display unit is a first display state, acquiring a first environment light parameter of an environment around the electronic device which is configured to adjust the display state and includes at least a second color temperature value of the environment.

In this embodiment, the step of determining a first display parameter of the display unit according to the first environment light parameter includes:

S20, judging, based on at least the second color temperature value in the first environment light parameter, whether the display state needs to be adjusted, and obtaining a first judgment result; and S30, adjusting the display state from the first display state to a second display state different from the first display state if the first judgment result indicates that the display state needs to be adjusted.

The display parameter corresponding to the second display state is the first display parameter. Thus the display unit displays with the first display parameter finally.

In S10, the acquiring a first environment light parameter of an environment around the electronic device which is configured to adjust the display state and includes at least a second color temperature value of the environment in the case where the display state of the display unit is a first display state includes: obtaining, by an environment detection apparatus in the electronic device, the first environment light parameter of the environment which is configured to adjust the display state and includes at least the second color temperature value of the environment, wherein, the first environment light parameter can also include: a brightness parameter and a chrominance parameter.

In a specific embodiment, an intelligent television is taken as an example, and a display unit of the intelligent television will record the current display state while displaying pictures, for example, the current display state is the first display state in which brightness is medium, chrominance is good and the second color temperature value of the environment is 6500 K. At this time, an environment detection apparatus provided inside the intelligent television is always in a detection state. Specifically, the environment detection apparatus may be a photosensitive sensor. Therefore, the photosensitive sensor will always detect a change in the current external environment light, for example, since it is sunny in the day and the light is stronger, the photosensitive sensor will detect the first environment light parameter, which is obtained at a certain period in the day and in which brightness is stronger, chrominance is medium and the second color temperature value of the environment is 7000 K; for example, since there is no other natural light irradiation except for moonlight irradiation in the night and the light is darker, the photosensitive sensor will detect the first environment light parameter, which is obtained at a certain period in the night and in which brightness is weaker, chrominance is darker and the second color temperature value of the environment is 4100 K; in the case where a daylight lamp is used in the night, brightness of the external environment is slightly stronger than that in the case where there is only moonlight in the night, but is much weaker than that in the day. At this time, under the irradiation of the daylight lamp, chrominance of external environment is better than that in the case where there is only moonlight in the night, but is much poorer than that in the day. Meanwhile, under the irradiation of the daylight lamp, the second color temperature value of the environment is approximately 5000 K.

The chrominance and the color temperature (such as the second color temperature of the environment mentioned above) mentioned above are different, the chrominance means hues and saturation, which is specifically categories of color and purity of color; and the color temperature means a marker of spectral components of a white light source, eyes have different color senses to different color temperatures, the higher the color temperature of a light source is, the more the color temperature is biased to blue, and the lower the color temperature of a light source is, the more the color temperature is biased to red.

Of course, a change in external environment is not only the difference between day and night, and at different times of the day, brightness, chrominance and color temperature appeared are all different due to different angles of irradiation of sunlight.

After the acquiring a first environment light parameter of an environment, in an embodiment of the present invention, the method also includes: simulating a first state characteristic of a first target object displayed on the display unit corresponding to the first environment light parameter based on the first environment light parameter.

In the case where the first environment light parameter is a second color temperature value of the environment, the simulating a first state characteristic of a first target object displayed on the display unit corresponding to the first environment light parameter based on the first environment light parameter includes: simulating a first color temperature characteristic of a first target object displayed on the display unit corresponding to the second color temperature value of the environment; or in the case where the first environment light parameter is a brightness parameter, the simulating a first state characteristic of a first target object displayed on the display unit corresponding to the first environment light parameter based on the first environment light parameter includes: simulating a first brightness characteristic of the first target object displayed on the display unit corresponding to the brightness parameter; or in the case where the first environment light parameter is a chrominance parameter, the simulating a first state characteristic of a first target object displayed on the display unit corresponding to the first environment light parameter based on the first environment light parameter includes: simulating a first chrominance characteristic of the first target object displayed on the display unit corresponding to the chrominance parameter.

In a specific embodiment, an electronic document displayed on the intelligent television is taken as an example, of course, an electronic document displayed on a smart phone or an electronic document displayed on a tablet computer may also be taken as an example. At this time, based on the first environment light parameter obtained above, such as the first environment light parameter at noon of the day in which brightness of external environment is stronger, chrominance is medium and the second color temperature value of the environment is 7000 K, that is, based on the first environment light parameter at noon of the day, a first state characteristic of a paper when the paper is used to replace the electronic document displayed on the intelligent television is simulated in such environment, that is, the first state characteristic is a display state that the real paper object should present for a user under such environment condition, and the specific state includes: the value of brightness, the value of chrominance and the second color temperature value of the environment which are configured to external environment.

Of course, the above-listed electronic document displayed on the display unit of the intelligent television is not a limitation herein, and a character, scenery and the like in an image may also be used, and no specific limitation is made thereto in the present invention.

After the acquiring a first state characteristic of a simulation object, S20 is performed subsequently: judging, based on at least the second color temperature value of the environment in the first environment light parameter, whether the display state needs to be adjusted, and obtaining a first judgment result. The step includes:

judging whether the first state characteristic matches the first display state and obtaining a first judgment result; if the first judgment result indicates that the first state characteristic does not match the first display state, it indicates that the display state needs to be adjusted; if the first judgment result indicates that the first state characteristic matches the first display state, it indicates that the display state does not need to be adjusted.

In a specific embodiment, the above electronic document displayed on the intelligent television is taken as an example, the first environment light parameter of the current external environment has been obtained at the very beginning, and the first state characteristic of the simulation object is also obtained under the condition of the first environment light parameter. At this time, the first state characteristic may be compared with the first display state of the electronic document displayed on the intelligent television initially. For example, the above-obtained first display state, which the paper object should present for the user under external environment condition of simulation and in which brightness is stronger, chrominance is medium and the second color temperature value of the environment is 7000 K, is compared with the first display state of the electronic document displayed on the intelligent television, and in the first display state of the above electronic document, brightness is medium, chrominance is good and the second color temperature value of the environment is 6500 K. Therefore, it may be found that, brightness of the electronic document in the first display state is weaker than that of the real paper object under the current external environment, its chrominance is higher than that of the paper object under the current external environment, and its color temperature is lower than that of the paper object under the current external environment. Therefore, it is found based on the above analysis that, the first display state of the electronic document does not match the first state characteristic of the paper object under the environment, then the result obtained is that the first display state of the electronic document needs to be adjusted; if the obtained first state characteristic of the paper object matches the first display state of the electronic document under the current environment condition, the result obtained is that the first display state of the electronic document does not need to be adjusted.

In order to allow a user to obtain the same effect when viewing the electronic document and the paper object, if the display effect of the electronic document does not match that of the specific paper object, the first display state of the electronic document displayed on the intelligent television needs to be adjusted.

S30 is performed subsequently: adjusting the display state from the first display state to a second display state which is different from the first display state if the first judgment result indicates that the display state needs to be adjusted.

The step of S30 includes:

acquiring, based on the first state characteristic, target display adjustment data corresponding to the first state characteristic if the first judgment result indicates that the display state needs to be adjusted;

recording the target display adjustment data in a display state recording table in a storage device in the electronic device; and adjusting first display adjustment data corresponding to the first display state to target display adjustment data based on the target display adjustment data in the display state recording table, so as to adjust the display state from the first display state to a second display state corresponding to the target display adjustment data.

In a specific embodiment, since the first state characteristic of the specific paper object under the current environment has been obtained in the previous step, a target display adjustment data required for adjusting the first display state which does not match the first state characteristic may be determined according to the first state characteristic. For example, in the process of judging whether adjustment is to be performed, brightness of the electronic document in the first display state is found weaker than that of the real paper object under the current environment condition, then the target display adjustment data at this time includes: adjusting the value of brightness of the electronic document in the first display state (adjusting towards the direction of strong brightness); also adjusting in sequence the value of chrominance of the electronic document in the first display state (adjusting towards the direction of low chrominance); and also adjusting the second color temperature value of the environment of the electronic document in the first display state (adjusting towards the direction of high color temperature). The three adjusted data are a combination to adjust the first display state of the electronic document together.

The three adjusted data obtained above are packaged and recorded in a display state recording table in a storage device of the intelligent television. Data required to be adjusted is recorded in a form of a table, which can effectively ensure accuracy of adjustment, so that the object displayed on the display device which can be viewed by a user has color closer to that of the real object.

The first display state of the electronic document is adjusted based on the above-mentioned adjusted data recorded in the display state recording table. For example, in some cases, only one of brightness, chrominance and color temperature is required to be adjusted; of course, in some cases, two of brightness, chrominance and color temperature are required to be adjusted; of course, in some cases, brightness, chrominance and color temperature are required to be adjusted respectively. No specific limitation is made thereto in the specific embodiment. Of course, in embodiments of the present invention, the first environment light parameter is not limited to the above-mentioned brightness, chrominance and color temperature, and other first environment light parameters may also be used, for example, a first environment light parameter in tactility or olfaction may also be used subsequently, and no specific limitation is made thereto in the present invention.

An embodiment of the present invention provides an electronic device having a display unit, and the electronic device further includes: a first acquisition module 10 and a second determination module 40.

The first acquisition module 10 includes a first acquisition unit, configured to acquire, in the case where the display state of the display unit is a first display state, a first environment light parameter of an environment around the electronic device which is configured to adjust the display state and includes at least a second color temperature value of the environment.

The second determination module includes: a first judgment unit 20, configured to judge based on at least the second color temperature value of the environment in the first environment light parameter whether the display state needs to be adjusted, and to obtain a first judgment result; and a first adjustment unit 30, configured to adjust the display state from the first display state to a second display state different from the first display state in the case that the first judgment result indicates that the display state needs to be adjusted.

Furthermore, the first acquisition unit may be an environment detection apparatus in the electronic device, which is configured to obtain the first environment light parameter of the environment which is configured to adjust the display state and includes at least the second color temperature value of the environment, wherein, the first environment light parameter can also include: a brightness parameter and a chrominance parameter.

Furthermore, the electronic device further includes: a first simulation module, configured to simulate a first state characteristic of a first target object displayed on the display unit corresponding to the first environment light parameter based on the first environment light parameter.

Furthermore, the first simulation module includes: a color temperature simulation sub-unit, configured to simulate a first color temperature characteristic of a first target object displayed on the display unit that corresponds to a color temperature parameter in the case where the first environment light parameter is the second color temperature value of the environment; a brightness simulation sub-unit, configured to simulate a first brightness characteristic of a first target object displayed on the display unit corresponding to a brightness parameter in the case that the first environment light parameter is the brightness parameter; and a chrominance simulation sub-unit, configured to simulate a first chrominance characteristic of a first target object displayed on the display unit corresponding to a chrominance parameter in the case where the first environment light parameter is the chrominance parameter.

Furthermore, the first judgment unit 20 is configured to judge whether the first state characteristic matches the first display state and obtain a first judgment result; if the first judgment result indicates that the first state characteristic does not match the first display state, it indicates that the display state needs to be adjusted; if the first judgment result indicates that the first state characteristic matches the first display state, it indicates that the display state does not to be adjusted.

Furthermore, the first adjustment unit 30 includes: a first acquisition sub-unit, configured to acquire, based on the first state characteristic, target display adjustment data corresponding to the first state characteristic in the case where the first judgment result indicates that the display state needs to be adjusted; a recording unit, configured to record the target display adjustment data in a display state recording table in a storage device in the electronic device; and a first adjustment sub-unit, configured to adjust first display adjustment data corresponding to the first display state to target display adjustment data based on the target display adjustment data in the display state recording table, so as to adjust the display state from the first display state to a second display state corresponding to the target display adjustment data.

The above technical solutions in the embodiments of the present invention may have at least the following technical effects or advantages:

1. Since the technical solution is adopted where a first environment light parameter of the environment around the electronic device which is configured to adjust the display state and includes at least a second color temperature value of the environment is acquired and the display state of the electronic device is adjusted based on the first environment light parameter, the technical problem in the prior art that in the case where a change occurs on environment light, a target object displayed on a display device cannot change with a change in external environment light around eyes of a user is resolved effectively. And a technical effect that in the case where a change occurs on external environment light, the display state of the electronic device can be adaptively adjusted with a change in external environment light around eyes is achieved.

2. Since the technical solution that after the acquiring a first environment light parameter of an environment around the electronic device which includes at least the second color temperature value of the environment, simulating a first state characteristic of a first target object displayed on the display unit that corresponds to the first environment light parameter based on the first environment light parameter is also included is applied, the technical problem in the prior art that a target image displayed on a display device can not truly reflect the same change in color as that occurs on a realistic object in the case where current environment light is changed is resolved effectively. And a technical effect that the display state of the electronic device can be adjusted based on a simulation of a change in color of a realistic target object in the current environment is achieved.

Figure 8:
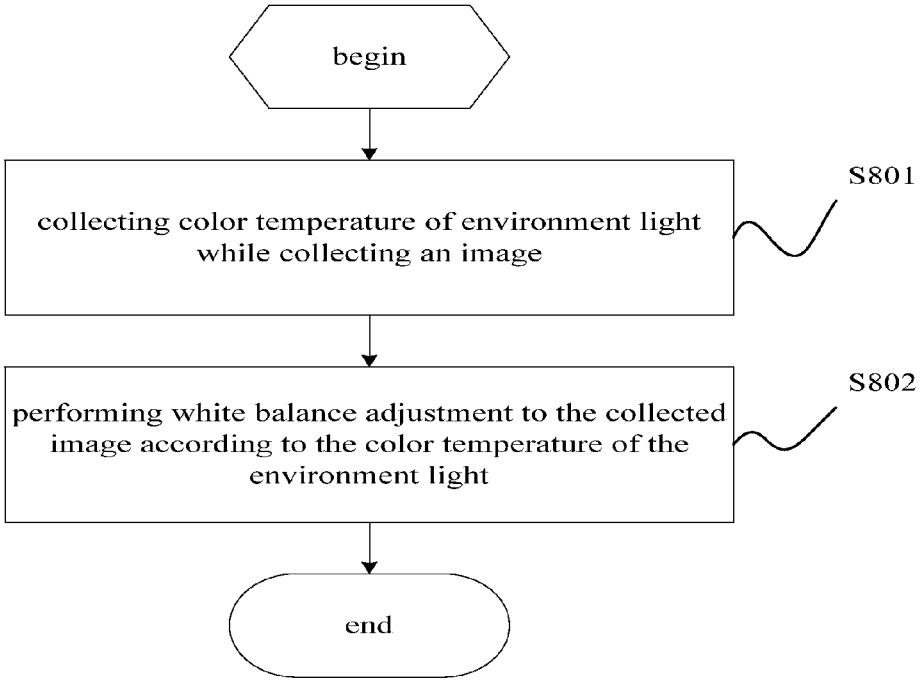
FIG. 8 is a flowchart of a method of displaying on an electronic device provided by an embodiment of the invention.

Furthermore, referring to FIG. 8, an embodiment of the present invention also provides a white balance control method, which includes the following steps.

Step S801: collecting color temperature of environment light (such as a second temperature value of the environment) by a sensor module while collecting an image by an image collection module.

In this step of the present embodiment, the sensor module works together with the image collection module, and when the image collection module takes a photo (i.e., collecting an image), the sensor module collects the color temperature of the environment light, such as the second color temperature value of the environment. That is, in this step, the environment color temperature is collected directly, rather than being obtained in a way of determining possible environment color temperature by comparing and analyzing the collected image after collecting the image.

Step S802: performing white balance adjustment to the collected image according to the color temperature of the environment light.

Each environment light corresponds to one color temperature, and different environment light correspond to different white balance adjustment algorithms. In this step, a corresponding white balance adjustment algorithm is determined according to the collected color temperature of the environment light, and then the white balance adjustment is made to the collected image by the determined white balance adjustment algorithm.

In this step, a white balance adjustment algorithm corresponding to the color temperature of the environment light can be acquired by looking-up a table (such as a comparison table of color temperatures and white balance adjustment algorithms), and white balance adjustment is made to the three primary colors of the collected image according to the white balance adjustment algorithm so that balance between proportions of the three primary colors of the image is achieved.

When there is no white balance adjustment algorithm corresponding to the color temperature of the environment light collected by the sensor module in the comparison table, the following way can be used: transforming the collected color temperature of the environment light by a preset transform algorithm; acquiring, according to the transformed color temperature of the environment light, an adjustment algorithm corresponding to the transformed color temperature of the environment light by looking up a table; and adjusting the three primary colors of the image according to the adjustment algorithm corresponding to the transformed color temperature, such that balance between proportions of the three primary colors of the image is achieved.

An embodiment of the present invention provides a white balance control method, in which the color temperature of the environment light is collected directly, and a reference point of the white balance can be determined accurately according to the collected color temperature, thus white balance adjustment can be made accurately to the acquired image, avoiding a problem that it is impossible to accurately determine an white balance adjustment algorithm and thus impossible to achieve accurate white balance since the value of a possible environment color temperature which is obtained by comparing and analyzing the acquired image has lower accuracy, thus the accuracy of the white balance adjustment is improved.

In the above embodiment, the collecting color temperature of environment light by the sensor module may include:

acquiring R, G, B values (i.e. three primary color values of the environment light) of the environment light (i.e. the shooting environment) by the sensor module, and determining the color temperature of the environment light according to the R, G, B values, for example acquiring the color temperature of the environment light by looking-up a table (a comparison table of color temperatures and RGB colors). Preferably, the sensor module can collect the R, G, B values by a three primary color sensor.

Figure 9:
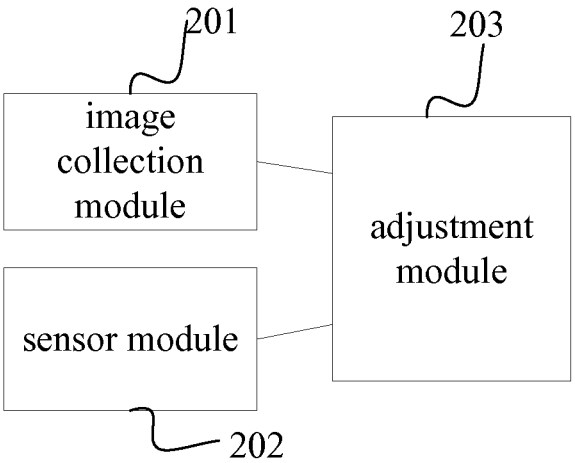
FIG. 9 is a structural schematic diagram of an electronic device provided by an embodiment of the invention.

Referring to FIG. 9, FIG. 9 is a structural schematic diagram of an electronic device provided by an embodiment of the invention, including:

an image collection module 201, a sensor module 202 (such as the first acquisition module 50 in FIG. 5) and an adjustment module 203.

The image collection module 201 is configured to collect an image, i.e. is configured to acquire an image of a scene to be photographed.

The sensor module 202 is configured to collect color temperature of environment light (such as a second color temperature of the environment).

In this embodiment, the sensor module 202 works together with the image collection module 201, i.e. while the image collection module 201 takes a photo (that is, collecting an image), the sensor module 202 collects the color temperature of the environment light.

The sensor module 202 is configured to collect the color temperature of the environment light.

In one embodiment, the sensor module 202 may be the first acquisition module 50 in FIG. 5, and the color temperature of the environment light collected by the sensor module 202 is the second color temperature of the environment acquired by the first acquisition module 50 in FIG. 5.

The adjustment module 203 is configured to perform white balance adjustment to the image according to the color temperature of the environment light.

An embodiment of the invention provides the electronic device with a white balance control function which collects the color temperature of the environment light by a sensor module, avoiding a problem that it is impossible to accurately determine an white balance adjustment algorithm and thus impossible to achieve accurate white balance since the value of a possible environment color temperature which is determined by comparing and analyzing the acquired image has lower accuracy, thus the accuracy of the white balance adjustment is improved.

Figure 10:
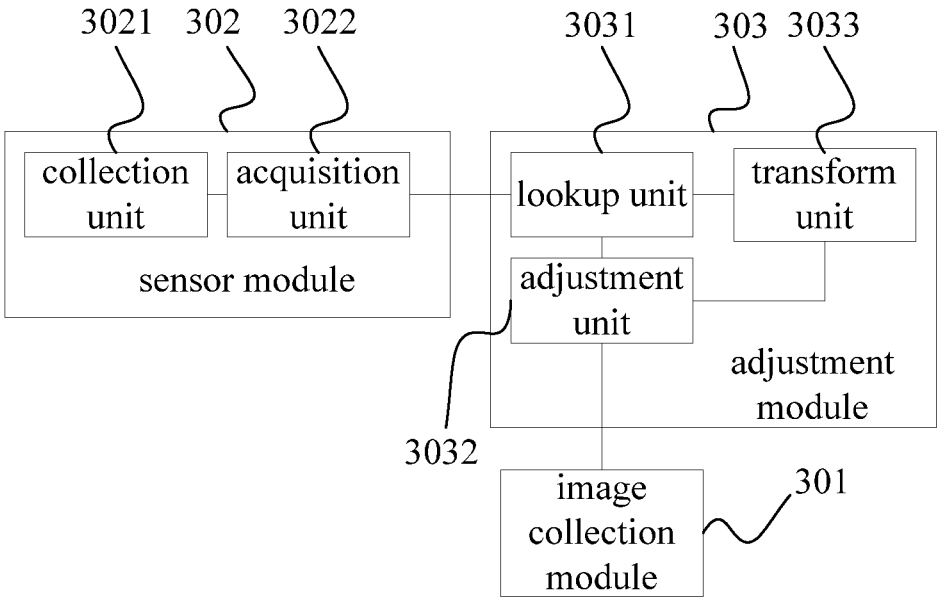
FIG. 10 is a structural schematic diagram of another electronic device provided by an embodiment of the invention.

Referring to FIG. 10, FIG. 10 is a structural schematic diagram of another electronic device with white balance control function provided by an embodiment of the invention, including:

an image collection module 301, a sensor module 302 (such as the first acquisition module 50 in FIG. 5) and an adjustment module 303.

The image collection module 301 is configured to collect an image; i.e. the image collection module 301 acquires an image of a scene to be photographed.

The sensor module 302 is configured to collect color temperature of environment light (such as a second color temperature of the environment).

Specifically, the sensor 302 includes:

a collection unit 3021, configured to collect R, G, B values (i.e., three primary color values of environment light) of the environment light, preferably, the collection unit 3021 may be a three primary color sensor; and an acquisition unit 3022, configured to acquire the color temperature of the environment light according to the R, G, B values, the acquisition unit 3022 can acquire the color temperature of the environment light by looking up a table (a comparison table of color temperatures and RGB colors).

The adjustment module 303 is configured to perform white balance adjustment to the image according to the color temperature of the environment light.

The adjustment module 303 may include:

a lookup unit 3031, configured to acquire an adjustment algorithm corresponding to the color temperature of the environment light by looking up a table; and an adjustment unit 3032, configured to adjust three primary colors of the image by a preset adjustment algorithm according to the color temperature of the environment light so that balance between three primary colors of the image is achieved.

In order to further optimize the embodiment described above, the adjustment module 303 further includes a transform unit 3033 configured to transform the color temperature of the environment light by a preset transform algorithm in the case where there is no adjustment algorithm corresponding to the color temperature of the environment light in the table, such that the color temperature is transformed into color temperature existing in the table.

Accordingly, the adjustment unit 3032 is further configured to adjust three primary colors of the image according to an adjustment algorithm corresponding to the transformed color temperature such that balance between proportions of the three primary colors of the image is achieved.

Obviously, various modifications and variations may be made to the invention by those skilled in the art without departing from the spirit and scope thereof. Thus, if these modifications and variations of the present invention fall within the scope of the invention as defined by the appended claims and their equivalent technology, the present invention is also intended to include these modifications and variations.

The invention claimed is:

1. A method of displaying on an electronic device with an environment light sensor, a display unit and an image capturing device, comprising:

acquiring a first environment light parameter of an environment around the display unit of the electronic device by the electronic device, the first environment light parameter including at least a brightness parameter, a colorimetric parameter and a color temperature value of the environment around the electronic device;

simulating a first brightness characteristic of a first target object displayed on the display unit based on the first environment light parameter, the first brightness characteristic corresponding to the brightness parameter;

simulating a first colorimetric characteristic of the first target object displayed on the display unit based on the first environment light parameter, the first colorimetric characteristic corresponding to the colorimetric parameter;

simulating a first color temperature characteristic of the first target object displayed on the display unit based on the first environment light parameter, the first color temperature characteristic corresponding to the color temperature value;

determining a first display parameter of the display unit according to the first environment light parameter, the first brightness characteristic, the first colorimetric characteristic and the first color temperature characteristic;

displaying the first target object on the display unit with the first display parameter;

determining a first reflection parameter of a target corresponding to the first target object;

determining a second reflection parameter of the display unit; and changing the first display parameter of the display unit to include a difference derived from the first reflection parameter and the second reflection parameter, wherein the difference comprises red, green, and blue components.

2. The method according to claim 1, wherein acquiring the first environment light parameter of the environment around the electronic device comprises:

when the display unit is in a first display state, acquiring the first environment light parameter of the environment around the electronic device for adjusting a display state;

wherein the method further comprises:

judging, whether the display state needs to be adjusted and obtaining a first judgment result according to at least the color temperature value of the environment in the first environment light parameter; and if the first judgment result indicates that the display state needs to be adjusted, acquiring the first display parameter for a second display state.

3. The method according to claim 2, wherein acquiring the first environment light parameter of the environment around the electronic device for adjusting the display state when the display unit is in the first display state comprises:

acquiring the first environment light parameter of the environment around the electronic device for adjusting the display state by an environment detection apparatus in the electronic device.

4. The method according to claim 1, wherein the first environment light parameter comprises an environment tristimulus value of the environment.

5. The method according to claim 1, wherein the electronic device further comprises an image collection module, and the method further comprising:

collecting an image by the image collection module while acquiring the color temperature value of the environment; and performing white balance adjustment to the image according to the color temperature value of the environment.

6. The method according to claim 1, wherein the color temperature value of the environment around the electronic device is a second color temperature value and the display unit has a first color temperature value.

7. The method according to claim 6, further comprising:

determining whether a difference between the first color temperature value of the display unit and the second color temperature value of the environment around the electronic device is not less than a first preset threshold before determining the first display parameter of the display unit.

8. The method according to claim 1, wherein determining the first display parameter of the display unit comprises:

determining the first reflection parameter of the target to be simulated; and determining the first display parameter of the display unit based on the first environment light parameter and the first reflection parameter.

9. The method according to claim 8, wherein determining the first display parameter of the display unit based on the first environment light parameter and the first reflection parameter comprises:

determining a first tristimulus value of the target to be simulated based on the first reflection parameter and an environment tristimulus value; and determining the first display parameter of the display unit based on the first tristimulus value.

10. An electronic device with an environment light sensor and an image capturing device, comprising:

a display unit;

a first acquisition module configured to acquire a first environment light parameter of an environment around the display unit of the electronic device, wherein the first environment light parameter comprises at least a brightness parameter, a colorimetric parameter and a color temperature value of the environment around the electronic device;

a brightness simulation sub-unit configured to simulate a first brightness characteristic of a first target object displayed on the display unit based on the first environment light parameter, the first brightness characteristic corresponding to the brightness parameter;

a colorimetric simulation sub-unit configured to simulate a first colorimetric characteristic of the first target object displayed on the display unit based on the first environment light parameter, the first colorimetric characteristic corresponding to the colorimetric parameter;

a color temperature simulation sub-unit configured to simulate a first color temperature characteristic of the first target object displayed on the display unit based on the first environment light parameter, the first color temperature characteristic corresponding to the color temperature value;

a determination module configured to determine a first display parameter of the display unit according to the first environment light parameter, the first brightness characteristic, the first colorimetric characteristic and the first color temperature characteristic, so that the display unit displays the first target object with the first display parameter;

a first determination sub-unit, configured to determine a first reflection parameter of a target corresponding to the first target object;

a fifth determination sub-unit, configured to determine a second reflection parameter of the display unit; and a second determination sub-unit, configured to change the first display parameter of the display unit to include a difference derived from the first reflection parameter and the second reflection parameter, wherein the difference comprises red, green, and blue components.

11. The electronic device according to claim 10, wherein the first environment light parameter is an environment tristimulus value of the environment.

12. The electronic device according to claim 10, wherein the first acquisition module comprises a first acquisition unit configured to acquire the first environment light parameter of the environment around the electronic device for adjusting a display state when the display unit is in a first display state;

wherein the determination module comprises a first judgment unit configured to judge whether the display state needs to be adjusted, and to obtain a first judgment result based on at least an environment color temperature parameter in the first environment light parameter; and wherein a first adjustment unit configured to adjust the display state from the first display state to a second display state if the first judgment result indicates that the display state needs to be adjusted, wherein the display parameter corresponding to the second display state is the first display parameter.

13. The electronic device according to claim 12, wherein the first judgment unit is configured to:

judge whether the first brightness characteristic, the first colorimetric characteristic and the first color temperature characteristic match the first display state, and obtain a first judgment result, wherein in a case that the first judgment result is negative, the first judgment result indicates that the display state needs to be adjusted; and in a case that the first judgment result is positive, the first judgment result indicates that the display state does not need to be adjusted.

14. The electronic device according to claim 10, further comprising an image collection module and an adjustment module, wherein:

the image collection module is configured to collect an image while the first acquisition module acquires the color temperature value of the environment; and the adjustment module is configured to perform white balance adjustment to the image according to the color temperature value of the environment.

15. The electronic device according to claim 10, wherein the color temperature value of the environment around the electronic device is a second color temperature value and the display unit has a first color temperature value.

16. The electronic device according to claim 15, wherein the determination module is further configured to determine whether a difference between the first color temperature value of the display unit and the second color temperature value of the environment around the electronic device is not less than a first preset threshold.

17. The electronic device according to claim 10, wherein:

the first determination sub-unit is configured to determine the first reflection parameter of the target to be simulated; and the second determination sub-unit is configured to determine the first display parameter based on the first environment light parameter and the first reflection parameter.

18. The electronic device according to claim 17, wherein the second determination sub-unit comprises:

a third determination sub-unit, configured to determine a first tristimulus value of the target to be simulated based on the first reflection parameter and an environment tristimulus value; and a fourth determination sub-unit, configured to determine the first display parameter based on the first tristimulus value.

* * * * *